United States Patent [19]

Klar

[11] Patent Number: 4,506,490

[45] Date of Patent: Mar. 26, 1985

[54] MACHINE FOR MANUFACTURING BAG-LIKE TWO-COMPARTMENT PACKAGES, PARTICULARLY TEA BAGS

[76] Inventor: Gerhard Klar, Friedrichshafener Strasse 10, D8992 Wasserburg, Bodensee, Fed. Rep. of Germany

[21] Appl. No.: 308,662

[22] Filed: Oct. 5, 1981

[30] Foreign Application Priority Data

Oct. 11, 1980 [DE] Fed. Rep. of Germany ..... 3038442

[51] Int. Cl.[3] ..... B65B 29/04

[52] U.S. Cl. ..... 53/134

[58] Field of Search ..... 53/134, 234, 567; 493/375; 83/326; 29/431, 773, 774, 783

[56] References Cited

U.S. PATENT DOCUMENTS

| | | | |
|---|---|---|---|
| Re. 29,838 | 11/1978 | Hackemann | 83/326 X |
| 467,040 | 1/1892 | Mellen | 53/234 X |
| 2,023,291 | 12/1935 | Roth | 83/326 X |
| 2,546,504 | 3/1951 | Head | 198/696 X |
| 3,017,731 | 1/1962 | Lohse | 53/373 |
| 3,774,369 | 11/1973 | Klar | 53/134 |
| 3,813,849 | 6/1974 | Stambera | 53/234 |
| 3,969,873 | 7/1976 | Klar | 53/134 |
| 3,978,639 | 9/1976 | Ferrozzi | 53/234 X |
| 4,115,913 | 9/1978 | Moriya | 29/431 |

FOREIGN PATENT DOCUMENTS

| | | | |
|---|---|---|---|
| 2120270 | 3/1979 | Fed. Rep. of Germany | 53/134 |
| 51169 | 5/1916 | Sweden | 83/326 |

*Primary Examiner*—John Sipos

*Attorney, Agent, or Firm*—McGlew and Tuttle

[57] ABSTRACT

An improved machine for making bag-like two-compartment packages of a pliant material, particularly tea bags, having a tag secured thereto by a thread, which are formed by folding operations and closed by staples from a flexible tube filled with separate servings amounts is disclosed. The improvement includes a plurality of axially parallel shafts extending side by side and mounted for displacement in a rotary or axial motion which are provided as actuating members that, directly or through intermediate members such as cam rails or cams, are provided laterally of a conveyor for controlling the individual movable parts of individual working assemblies.

8 Claims, 7 Drawing Figures

MACHINE FOR MANUFACTURING BAG-LIKE TWO-COMPARTMENT PACKAGES, PARTICULARLY TEA BAGS

FIELD AND BACKGROUND OF THE INVENTION

The invention relates to a machine for making bag-like two-compartment packages, particularly tea bags from a strand of a pliant material having a tag secured thereto by a thread, which are formed by folding operations and closed by staples, the material strand being a folded flexible tube filled with separate serving amounts of a substance, the material strand being continuously fed into the machine, and the machine being of the type having conveying means, a plurality of working assemblies including movable parts for cutting the material strand into individual sections, cutting the tag thread, folding the bag, the working assemblies including folding elements for forming the bottom and top of the bag, at least two elevating arms for bringing portions of the bag into an upright position, means for receiving the tags in one of the elevating arms, and means for cutting the bag strand and the thread tag.

West German Pat. Nos. 21 20 270 and 24 05 761, which corresponds to U.S. Pat. No. 3,969,873 (the disclosure of which is incorporated herein by reference) disclose machines of this kind which have proved extraordinarily satisfactory in practice. However, in these machines, the actuation of the individual assemblies which, according to the first-mentioned patent, are stationary, and according to the second mentioned patent, are carried on a conveyor sequentially passing through the zones of individual function, is extremely expensive. In addition, the control elements are provided in close proximity to the respective working station, so that the product to be packed cannot be prevented from occasionally falling on the elements. This frequently causes disturbances and interruptions in operation, since the mostly small, interconnected parts of the drives are very sensitive to dust. Further, only the actuating members of a single working station can be controlled in this way.

SUMMARY OF THE INVENTION

The invention is directed to a machine of the above-mentioned kind in which the control elements are provided not in the operating range proper of the machine, but at locations spaced from the individual actuating members, so that the operation cannot be affected by the product to be packed. Further, the adjustment of the individual assemblies is to be executable by simple basic motions, without complicated transmissions susceptible to troubles, while still insuring an actuation true to function and sequence. The main objective to be achieved by the design of the control means and transmission members is, however, to make possible a simultaneous actuation of a plurality of assemblies of juxtaposed working stations without additional expenditures, so that a plurality of packages can be made at the same time in a single machine. Also, the total manufacturing expenses are to be reduced as compared to prior art machines, and a high reliability in service is to be ensured.

In accordance with the invention, in a machine for making bag-like two-compartment packages, particularly tea bags, from a strand of pliant material having a tag secured thereto by a thread, which are formed by folding operations enclosed by staples, the material strand being a folded flexible tube filled with separate serving amounts of a substance, the material strand being continuously fed into the machine, and the machine being of the type having conveying means, a plurality of working assemblies including movable parts of cutting the material strand into individual sections, cutting the tag thread, and folding the bag, the working assemblies including folding elements for forming the bottom and top of the bag, at least two elevating arms for bringing portions of the bag into an upright position, means for receiving the tags in one of the elevating arms, means for cutting the bag strand and the thread tag, an improvement, in combination therewith, wherein each of the assemblies comprises axial parallel shafts extended side by side and mounted for at least one of axial and rotary displacement for operating the working assemblies, and control means mounted adjacent the conveying means for controllingly engaging the shafts and operating the working assemblies.

In accordance with the invention, it is advantageous to provide a common housing, the shafts of the assemblies of each working assembly being mounted for displacement in the common housing, and the common housing being separated from the moving parts of the assemblies.

It is further advantageous, in accordance with the invention, if at least two identical working assemblies are provided in juxtaposition on the conveying means, the movable parts of the assemblies being mounted side by side and conjointly controllable by the axially parallel shafts which extend therethrough for operation of actuating members. In this way, the packing capacity of the machine may be doubled or otherwise multiplied at small expense.

In accordance with a preferred embodiment of the invention, the housings accommodating the actuating shafts are provided at a side of each individual working assembly intermediate adjacent working assemblies so that a correct mounting of the shafts is permanently ensured.

A preferred embodiment of the conveying means comprises at least two endless link chains, drivable socket wheels carrying the chains and the sprocket wheels being secured to the housing.

The inventive machine is not only simpler in construction, and thus more economical in manufacture than prior art machines of this kind, but also more versatile and widely unsusceptible to troubles. Primarily, however, the packing capacity of a single machine can thereby be doubled or multiplied with only small additional expenses. That is, if the movable parts of the individual working stations are actuated by axially parallel shafts which are mounted for displacement or rotation, and actuated at one of their ends by cams or similar control means, such control means can be provided outside the working zone at locations where they cannot be affected by the product to be packed. This reliably eliminates disturbances caused by soiling.

Further, the movements of the individual parts of the assemblies can be adjusted with great accuracy and accurately maintained, even though the shafts acting as actuating members are only displaced in their axial direction or rotated, since the respective required controlled motion can be exactly predetermined by the cams. The expenses of manufacture and assembly in this regard are very small, and in spite of that, a continuous trouble free operation over a long period of time is ensured since the cams do not soil and are wear resistant.

A particular advantage of the invention is that the movable parts of a plurality of juxtaposed assemblies can be actuated simultaneously by means of a single shaft of any length. This makes it possible to provide on a single machine two or more working stations operating simultaneously, so that the packing capacity is multiplied without at the same time augmenting the labor costs necessary for supervising the automatically performed packing operations. Only additional, advantageously series manufactured working stations are to be provided on the conveying means to obtain a considerably increased capacity at small expenses.

Accordingly, it is an object of the invention to provide an improved machine for making bag-like two compartment packages, particularly tea bags, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
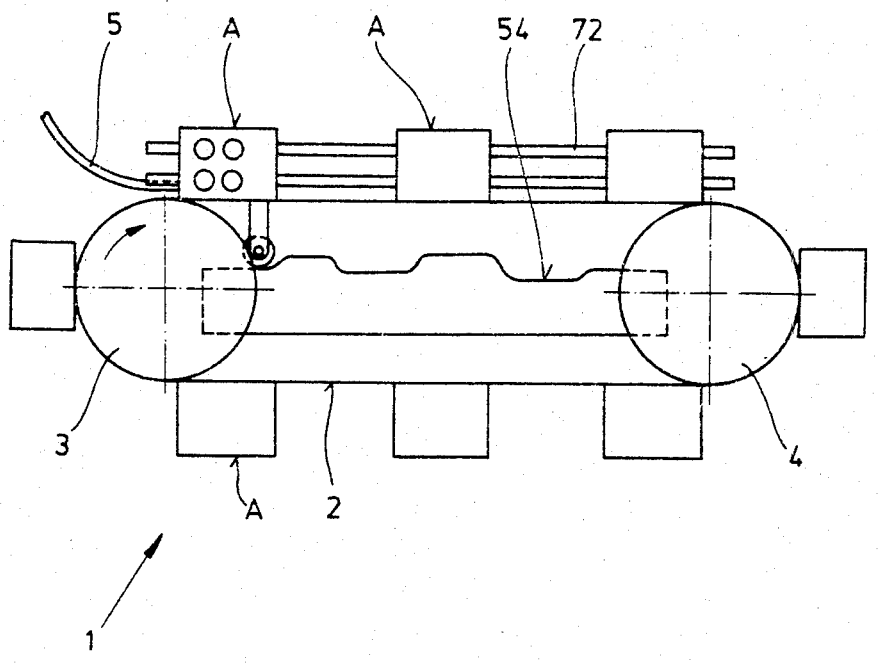
FIG. 1 is a schematic view of a machine comprising several working stations mounted on a driven conveyor chain.
Figure 2:
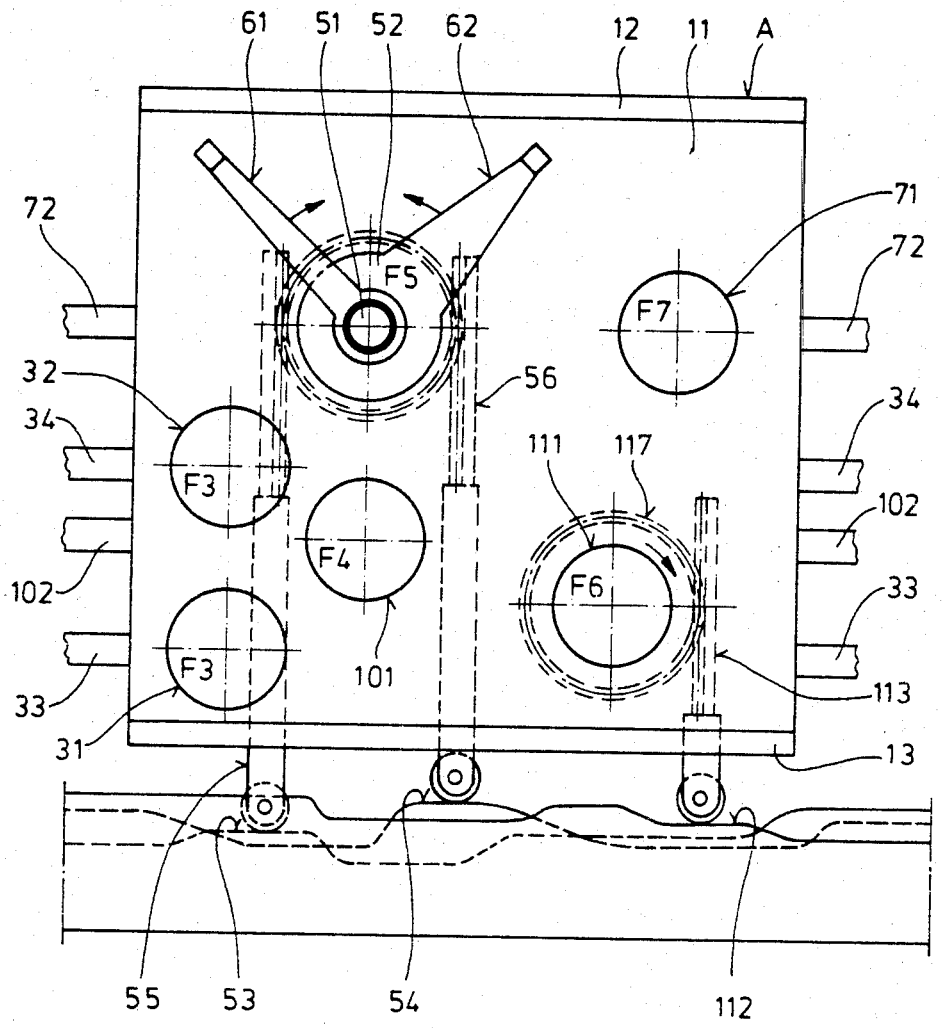
FIG. 2 is a front view of a housing associated with one of the working stations and accommodating shafts which are mounted therein for control by cams which are designed to actuate the movable parts of a working station.

FIG. 1 is a schematic illustration of a machine, generally designated by reference number 1, for making bag-like double compartment packages, from a continuously fed-in material strand 5, which is filled with separate serving amounts (dosed portions) of substance to be packaged, and folded to a flexible tube (not shown). The machine 1, as embodied in FIG. 1, comprises an endless link chain 2 which is trained over drivable sprocket wheels 3,4 mounted on a frame of the machine, and individual working stations, generally designated by reference character A, mounted at running endless chain 2.

The individual working stations A each include each of the assemblies shown in FIGS. 3 to 7. The assemblies are intended to perform the operations of cutting the material strand 5 into individual sections, cutting a tag-thread 8, folding the bag 6 into a W-shaped configuration, positioning the filled bag parts upright, folding the head corners 7 of the bag into a doubled position 7' and feeding the tag-thread.

The movement of the displaceable parts of the assemblies A are controlled by cams and coordinated with each other in such a way that due to their cooperation, finished two-compartment bags 6 are automatically made in machine 1 from the material strand 5.

Cam rails or cams 33, 34, 53, 54, 72, 102 and 112 control shafts 31, 32 51, 52, 71, 101, 111, respectively. The shafts are mounted in a box-like housing which is 11, closed in a dust-tight manner by covers 12,13. The cams are provided laterally of conveyor chain 2, between sprocket wheels 3 and 4, so that a partly axial motion and a partly rotary motion is imparted to the shafts as described hereinafter, as the housing moves past the cam rails. It is further possible to provide a plurality of working stations closely adjacent each other on link chain 2, so that the machine capacity can be multiplied with low additional expenses. Each station comprises a housing 11 with its collection of shafts.

Figure 3:
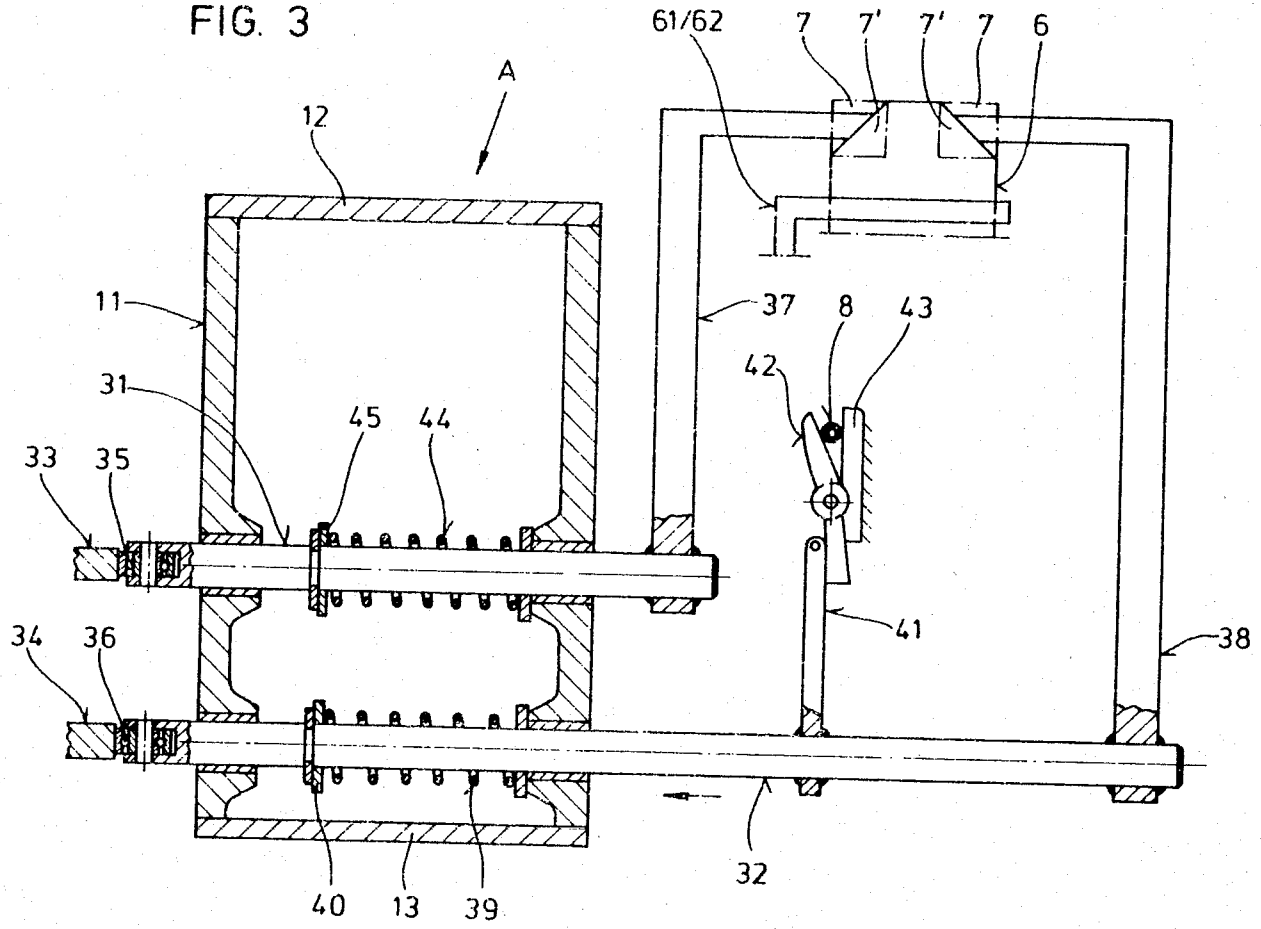
FIGS. 3 through 7 are cross-sectional views of the individual working assemblies of the work station of FIG. 2.

As shown in FIG. 3, shafts 31, 32 are connected to folder bars 37, 38. The movements of the shafts 31, 32 are controlled by the stationary cams 33, 34 through rollers 35, 36. Rollers 35, 36 are permanently urged onto the cams by springs 39,44 which bear against housing 11 and against discs 40, 45 secured to shafts 31, 32.

Figure 5:
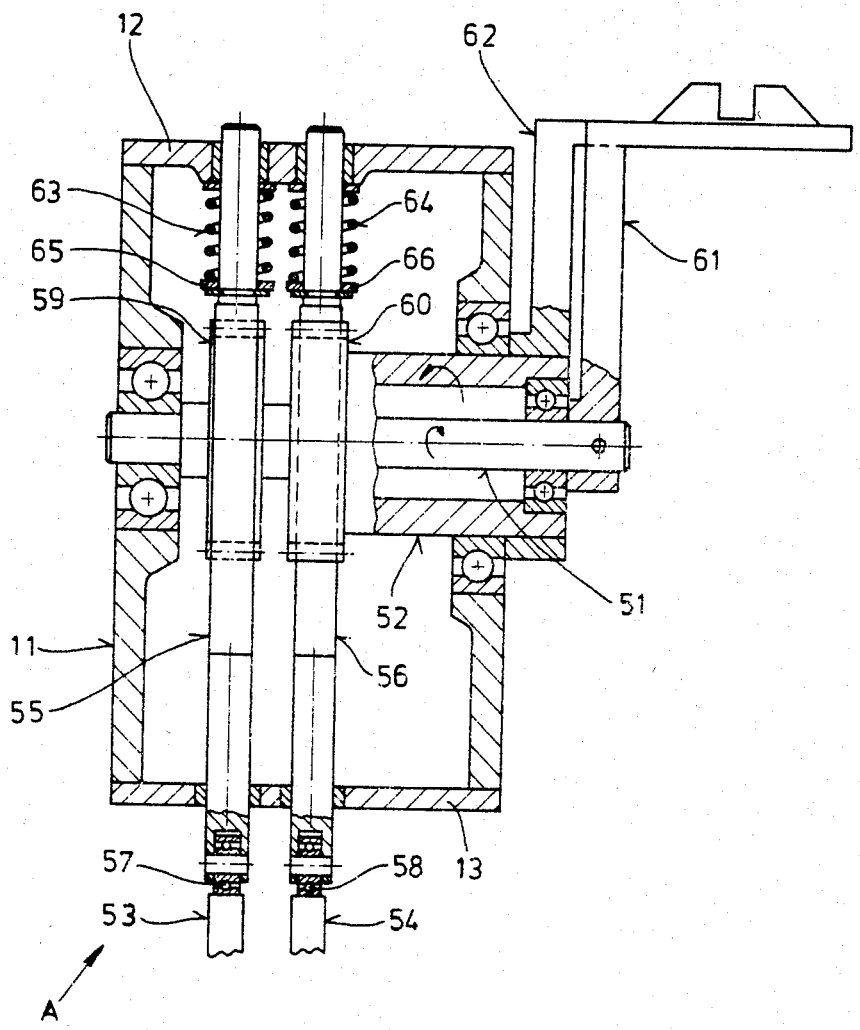

While a bag 6, held fast by means of elevating bars 61,62 shown in FIG. 5, is moved through, that is, between folder bars 37, 38 which during this motion remain in their positions shown in FIG. 3, initially the upper bag corners 7 are bent through ninety degrees. This is due to the triangular shape of the ends of bars 37,38 and the fact that the bag 6 is moved in a direction into the plane of FIG. 3 and between the bars. Then, folder bars 37,38 are moved toward each other so that corners 7 are further folded inwardly, through a further ninety degrees, and come into their doubled position 7'. In this second phase, folder bar 37 is moved to the right against the action of a spring 44, while folder bar 38 is moved by the action of a spring 39 by which shaft 32 is urged to the left, as viewed in FIG. 3, against cam 34 which has a corresponding recess (not shown) at the respective location. The functioning of bars 61,62 in FIG. 5, to hold and move bag 6, will be described later in greater detail.

Shaft 32 carries a stop 41 by which a cutting knife 42 is actuated which cooperates with a fixed counterblade 43 to cut the tag-thread at a proper instant, after a tag end thread are connected to the bag in a manner not shown.

Figure 4:
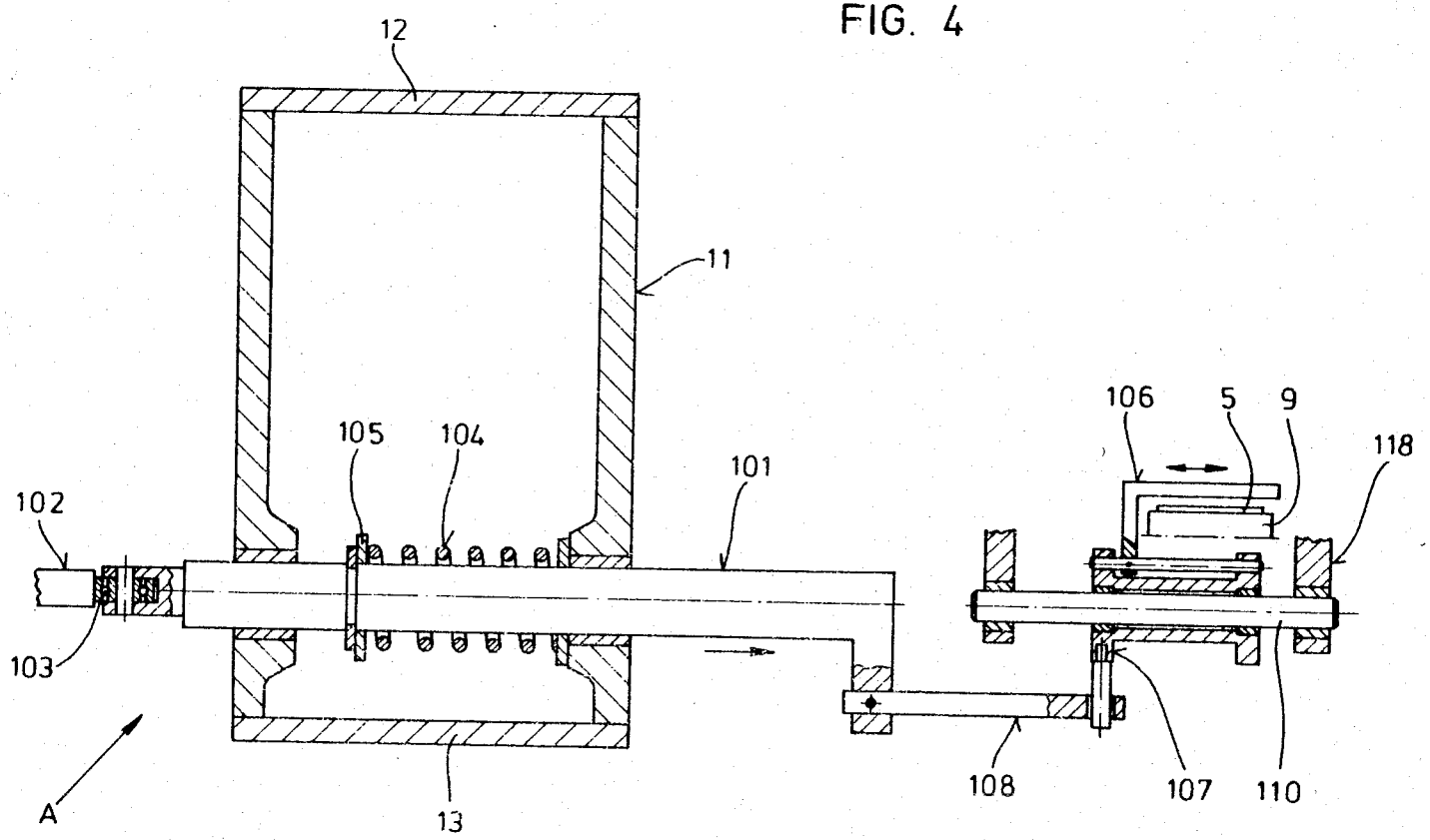
Figure 6:
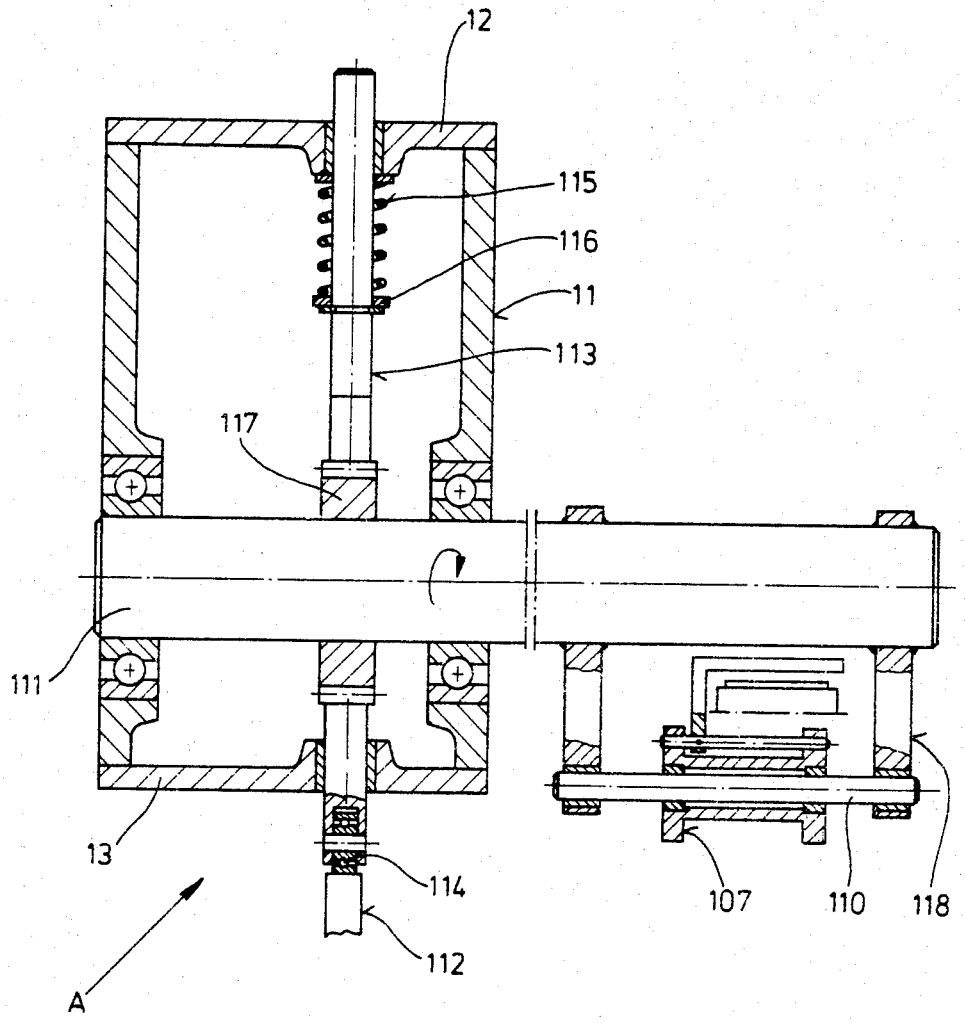

The W-shaped bottom fold of bag 6 is made by means of an angled hold-down plate 106 shown in FIGS. 4 and 6, which can be laterally moved to the right in FIG. 4, over material strand 5 by means of shaft 101. The plate 106 can then be pressed down against material strand 5 by means of another shaft 111 shown in FIG. 6. The bag bottom is then folded in cooperation with folder strips 9 and elevating bars 61, 62.

Shaft 101, which is mounted for displacement in housing 11 and bears against cam 102 through a roller 103, is displaceable by cam 102 against the action of a spring 104 clamped between the housing 11 and a disc 105 secured to shaft 101. Since hold-down plate 106 is fixedly secured to a sleeve 107 which is mounted for displacement on a pin 110 and connected to shaft 101 through a link 108, as shown in FIG. 4, the axial motion of shaft 101 is transferred to the hold-down. The engagement of link 108 and sleeve 107 over a pin shown in FIG. 4, also allows for controlled rotation of sleeve 107 as shaft 111 rotates.

To press hold-down plate 106 into contact with material strand 5, pin 110, carrying the hold-down plate 106 is swung by means of rotary shaft 111. The swinging motion is effected by a cam 112 bearing through a roller 114 against a rack 113 which is mounted for displacement in housing 11 and meshes with a gear 117 secured to shaft 111. With a displacement of rack 113 upwardly, for example, against a return spring 115 bearing on the rack through a disc 116, shaft 111 and arms 118 which are rigidly secured thereto and shown in a position turned through ninety degrees, and, consequently, support pin 110 and sleeve 107 are pivoted, so that hold-down plate 106 is applied against material strand 5. The individual movements, of course, are coordinated so that initially, strand 5 can be introduced without obstacles and, only then, the operations of folding the bottom, cutting, and raising to upright position, are performed.

Figure 7:
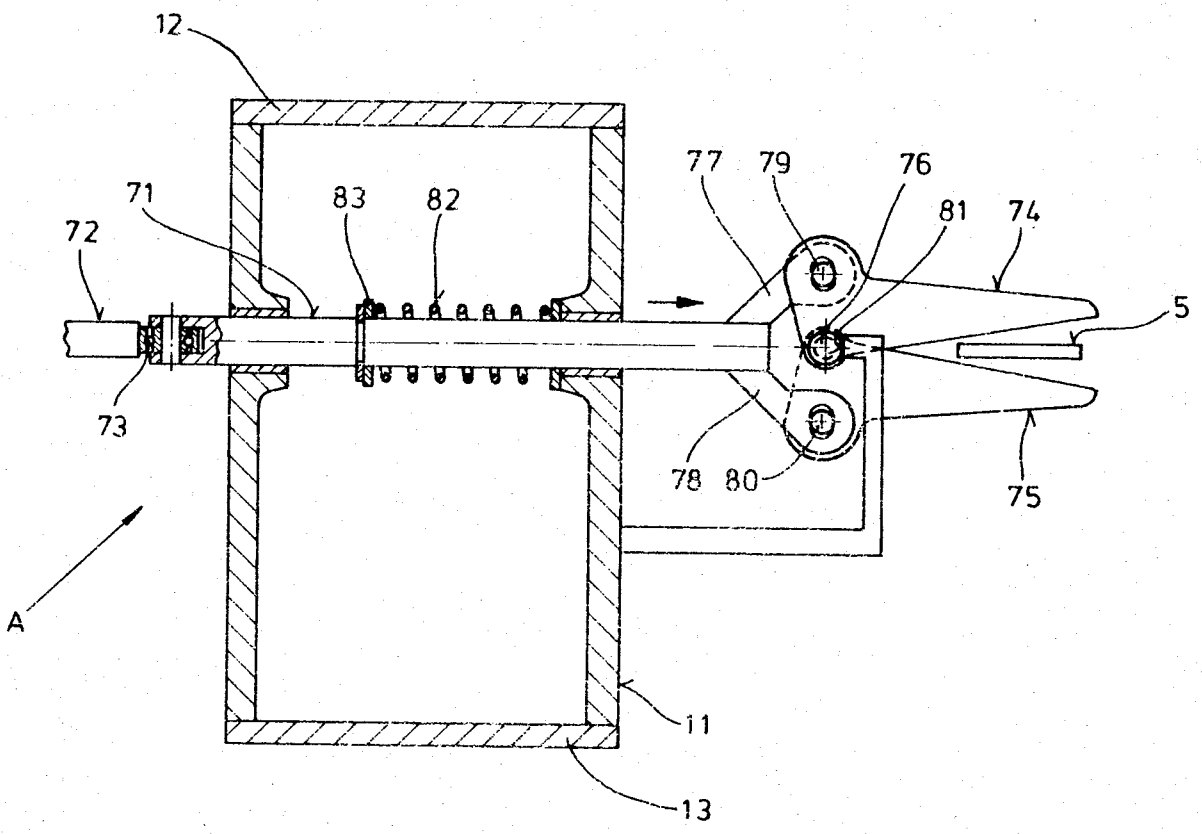

Material strand 5 is cut into sections by means of scissor arms 74,75 shown in FIG. 7. The scissor arms 74,75 are connected to each other by a hinge pin 76 and can be swung in the direction of strand 5 by means of an axially displaceable shaft 71. Scissor arms 74,75 are hinged to shaft 71 through lugs 77, 78 and bolts 79, 80. Shaft 71 mounted in housing 11 bears through a roller 73 on a cam 72 and is displaceable against the action of a spring 82 which is clamped between the housing and a disc 83. In addition, a stop 81 is provided on housing 11 at the level of hinge pin 76.

If upon an axial displacement of shaft 71, hinge pin 76 butts against stop 81, and shaft 71 is displaced farther to the right, the two scissor arms 74,75 are pivoted toward each other and material strand 5 is cut. Thus, no unfavorable axial motion of the cutting tool takes place during the cutting operation.

The filled-up back parts of the material strand are raised to upright position by means of already mentioned elevating bars 61,62 shown in FIG. 5. To this end, elevating bars 61, 62 are moved toward each other by means of shafts 51, 52 which again are mounted in housing 11. Racks 55, 56 are provided which bear against cams 53,54 through rollers 57, 58 and mesh with gears 59, 60 which are rigidly secured to shafts 51, 52. Shafts 51, 52 which extend within each other, with shaft 52 being hollow. The shafts 51,52 are returned to their initial positions by springs 63,64 which urge racks 55, 56, through disc 65,66 secured thereto, into permanent contact with cams 53,54.

This design makes it possible to transfer any required control movement through the axially displaceable or rotatable shafts to the parts to be moved of an assembly of a working station, and to provide the control means outside the working range, so that soiling and disturbances in operation resulting therefrom do not occur since the return springs and the component parts necessary for transforming the movements are mounted within the closed housing 11. In addition, the individual control movements which partly overlap one another can be initiated and performed exactly, in a simple manner by means of the cams.

Thus, in accordance with the invention, there is provided a machine for manufacturing bag-like two-compartment packages from a strand of a pliant material suitable for infusion, particularly tea bags, which are formed by folding and closed with staples, the material strand being a folded flexible tube filled with separate serving amounts of substance. The material strand is continuously fed-in, and working assemblies are provided as working stations on a continually running conveying means. The working stations are controllable by means provided outside the path of conveyance. The working assemblies comprise folding elements for forming the bottom and the top or head of the bag, two elevating arms for bringing the bag halves into upright position, a device for receiving the tags in one of the elevating arms, as well as mechanisms for cutting the bag strand and the thread carrying the tag, and are characterized in that to control the movable parts of the individual assemblies 37,38,61,62, 74,75,106 of the stations A, axially parallel shafts 31,32,51,52, 71,101,102 extending side by side and mounted for displacement or rotary motion or both, are provided as actuating members which, in turn, are actuable directly or through intermediate members by cam rails or cams 33,34,54,72,102,112 or similar control means provided within or laterally of the conveying means 2, and which can be coupled to the movable parts of the assembly.

The inventive machine is advantageously characterized in that all of the shafts (31, etc.) of the assemblies (37, etc.) of a single working station A are mounted for displacement or rotary motion, or both, in a common housing 11 which is separated from the movable parts of the assemblies, or in more such housings.

The inventive machine may be further advantageously characterized in that two or more identical working stations A are provided in juxtaposition on the conveying means 2, that the movable parts of the assemblies mounted side by side are conjointly controllable by throughgoing axially parallel shafts (31, etc.) operating as actuating members, and that individual movable parts may be coupled to each other.

The inventive machine may be even further advantageously characterized in that the housings 11 accommodating member (shafts 31, etc.) are provided at one or both sides of the individual working stations A and, if a plurality of working stations is provided one after the other, preferably therebetween.

A preferred embodiment of the inventive machine is characterized in that the conveying means comprises two or more endless link chains which are run about drivable sprocket wheels 3,4 and to which the housings 11 accommodating the actuating members (shafts 31, etc.) are secured.

To cut the strand of material 5, two scissor arms 74,75 hinged to a displaceable shaft 71 are provided which are pivoted to each other by a pivot pin 76, with the pivot pin 76 being associated with a stop 81 which is fixed, preferably to the housing 11 accommodating the displaceable shaft 71, and against the pivot pin 76 butts during a cutting operation to be performed by an axial displacement of the shaft 71 (FIG. 7). To make the head folds 7,7' of the bag 6, two angled folder bars 37, 38 are provided which, as actuating members, are separately secured to displaceable shafts 31,32 and that by means of cam rails or cams 33, 34 and the shafts 31,32, the folder bars 37,38 can be actuated also individually in such a way that initially one of the tube parts of the stand 5 of material is moved past the folder bars and that in order to bend the head corners of the bag by about 90°, they are held in fixed position and then moved in a controlled manner towards each other to double the corners.

On one of the displaceable shafts 31,32, preferably on the shaft 32 associated with the folder bars 37,38, a stop 41 is provided by means of which a cutting mechanism 42 is actuable to cut the tag thread 8.

The inventive method is even still further characterized in that to bring the two bag parts into upright position, two concentrically mounted elevating bars 61,62, pivotable toward each other, are provided as actuating members on shafts 51,52 which are mounted within each other for rotation in the housing 11 (FIG. 5). To actuate the individual shafts 51,52, mechanisms are provided for transforming a linear motion into a rotary motion, for example gears 59,60 or pulleys secured to the shafts and cooperating with racks 55,56 or draw elements, worm gears, or the like.

To make the fold in the bottom of the bag by a cooperation of fold strips 9 with the elevating bars 61,62, fold-down plate or angle lever 106 is provided which can be introduced as an actuating member into the zone of the bag strand 5 by means of a displaceable shaft 101 and which is mounted for displacement on a pin 110, and that to press the angle lever 106 against the bag strand 5, the pin 110 as actuating member can be swung by means of another shaft 111 which is rotatable by means of a cam 112, as well as of a rack 113 and a gear 114.

With a plurality of juxtaposed assemblies, the angle levers 106 and/or the pins 110 and/or the structural parts supporting these elements, are coupled to each other.

While a specific embodiment of the invention has been shown and described in detail to illustrate the application of the principles of the invention, it will be understood that the invention may be embodied otherwise without departing from such principles.

What is claimed is:

1. A machine for manufacturing a two-compartment bag having a tag connected thereto by a thread, and made from a strand of pliant material which is folded into a flexible tube and is filled with separate serving amounts of a substance comprising:

conveyor means defining a conveyor path;

at least one work station engaged with said conveyor means for movement of said work station along said conveyor path;

a plurality of cam rails extending parallel to said conveyor path and spaced from said conveyor means;

said work station comprising a closed housing defining an interior space, end folding means movably mounted to said housing having a pair of folding elements for folding ends of a strand from which a bag is to be made, elevating means movably mounted to said housing and including a pair of elevating arms for engaging ends of a strand from which a bag is to be made for moving the strand ends into an upright position, strand cutting means movably mounted to said housing including a least one strand cutting element for cutting a strand from which a bag is to be made, and thread cutting means movably mounted to said housing and including at least one thread cutting element for cutting a thread which connects a tag to a strand from which a bag is to be made;

each of said folding means, elevating means, strand cutting means and thread cutting means including at least one shaft movably mounted to said housing and having a first portion extending in said interior space and a second portion extending out of said interior space, each shaft being parallel to each other shaft and being one of rotatably and axially movable with respect to said housing;

at least one of said folding elements, at least one of said elevating arms, said at least one strand cutting element and said at least one thread cutting element each being engaged to said second portion of a shaft;

cam rail engaging means extending into said housing and connected to each first portion of each shaft, each cam engaging means including a cam rail engaging element movable into engagement with at least one of said cam rails, so that movement of said closed housing on said conveyor path causes relative movement between each cam rail engaging element and at least one of said cam rails to move said end folding means, said elevating means, said strand cutting means and said thread cutting means; and said end folding means including said at least one shaft and one additional shaft, each of said folding elements connected to each shaft of said end folding means, each shaft of said end folding means being axially movable to said housing, each folding element comprising an angled folder bar between which a strand end is movable for folding portions of the strand end.

2. A machine according to claim 1, including a plurality of said working stations engagable with said conveyor means and each movable by said conveyor means along said conveyor path, in sequence.

3. A machine according to claim 1, wherein said conveyor means comprises a pair of spaced apart sprocket wheels, said conveyor path extending between said sprocket wheels, and at least two endless link chains engaged around said pair of sprocket wheels, said housing connected to said pair of endless link chains for movement of said housing along said conveyor path.

4. A machine according to claim 1, wherein said strand cutting means comprises a second strand cutting element, said at least one strand cutting element and said second strand cutting element each comprising a scissor arm, said shaft of said strand cutting means pivotably connected to each of said scissor arms and being axially displaceable by said cam rail engaging means of said strand cutting means, and a first stop fixed to said housing and engaged by said scissor arms with movement of said strand cutting means shaft for cutting a strand.

5. A machine according to claim 1, wherein the shaft of said thread cutting means comprises said second shaft of said end folding means, a second stop connected to said shaft of said thread cutting means and engageable with said thread cutting element for cutting a thread.

6. A machine according to claim 1, wherein said elevating means includes said at least one shaft and one additional shaft, both said at least one shaft and said one additional shaft being rotatably mounted to said housing and parallel to each other, one of said two elevating arms connected to said at least one shaft of said elevating means and the other of said two elevating arms connected to said additional shaft of said elevating means, said elevating arms being rotatable by said at least one and additional shafts of said elevating means for moving strand ends to an upright position.

7. A machine according to claim 6, wherein said cam rail engaging means engaged with said elevating means comprises a pinion connected to each of said at least one and said additional shafts of said elevating means and a rack engaged with each pinion and mounted for linear motion in said housing.

8. A machine for manufacturing a two-compartment bag having a tag connected thereto by a thread, and made from a strand of pliant material which is folded into a flexible tube and is filled with separate serving amounts of a substance, comprising:

conveyor means defining a conveyor path;

at least one work station engaged with said conveyor means for movement of said work station along said conveyor path;

a plurality of cam rails extending parallel to said conveyor path and spaced from said conveyor means;

said work station comprising a closed housing defining an interior space, end folding means movably mounted to said housing having a pair of folding elements for folding ends of a strand from which a bag is to be made, elevating means movably mounted to said housing and including a pair of elevating arms for engaging ends of a strand from which a bag is to be made for moving the strand ends into an upright position, strand cutting means movably mounted to said housing including at least one strand cutting element for cutting a strand from which a bag is to be made, and thread cutting means movably mounted to said housing and including at least one thread cutting element for cutting a thread which connects a tag to a strand from which a bag is to be made;

each of said folding means, elevating means, strand cutting means and thread cutting means including at least one shaft movably mounted to said housing and having a first portion extending in said interior space and a second portion extending out of said interior space, each shaft being parallel to each other shaft and being one of rotatably and axially movable with respect to said housing;

at least one of said folding elements, at least one of said elevating arms, said at least one strand cutting element and said at least one thread cutting element each being engaged to said second portion of a shaft;

cam rail engaging means extending into said housing and connected to each first portion of each shaft, each cam engaging means including a cam rail engaging element movable into engagement with at least one of said cam rails, so that movement of said closed housing on said conveyor path causes relative movement between each cam rail engaging element and at least one of said cam rails to move said end folding means, said elevating means, said strand cutting means and said thread cutting means, means for forming a strand into a W-shape including two additional shafts parallel to said at least one shaft of said folding, elevating, strand cutting and thread cutting means, a pin connected to one of said two additional shafts, a sleeve axially and rotatably mounted on said pin, an angle lever connected to said sleeve and movable to fold a strand, the other of said two additional shafts being connected to said pin and movable axially in said housing for moving said angle lever over a strand to be folded, an additional cam rail engaging means engaged with said two additional shafts and at least one of said cam rails.

* * * * *